US011166092B2

(12) United States Patent
Lin et al.

(10) Patent No.: US 11,166,092 B2
(45) Date of Patent: Nov. 2, 2021

(54) HEAD PHONE STRUCTURE HAVING TWO CHAMBERS

(71) Applicant: Merry Electronics(Shenzhen) Co., Ltd., ShenZhen (CN)

(72) Inventors: Chia-Chung Lin, Taichung (TW); Jyun-Neng Liao, Taichung (TW); Ming-Xue Cai, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 31 days.

(21) Appl. No.: 16/741,754

(22) Filed: Jan. 14, 2020

(65) Prior Publication Data

US 2021/0099783 A1 Apr. 1, 2021

(30) Foreign Application Priority Data

Sep. 26, 2019 (TW) ..... 108134851

(51) Int. Cl.
*H04R 1/10* (2006.01)
*H04R 1/02* (2006.01)

(52) U.S. Cl.
CPC ..... *H04R 1/1008* (2013.01); *H04R 1/02* (2013.01); *H04R 1/1075* (2013.01); *H04R 2460/11* (2013.01)

(58) Field of Classification Search
CPC . H04R 1/02; H04R 1/021; H04R 1/10; H04R 1/1008; H04R 1/1058; H04R 1/1066; H04R 1/1075; H04R 1/20; H04R 1/22; H04R 1/28; H04R 1/2803; H04R 1/2807; H04R 1/2811; H04R 1/2815; H04R 1/2819; H04R 1/2823; H04R 1/2826; H04R 1/2838; H04R 1/2842; H04R 1/2846; H04R 1/2849; H04R 1/2853; H04R 1/2857; H04R 1/2861; H04R 1/2865; H04R 1/2869; H04R 1/2873; H04R 1/2884; H04R 1/2888; H04R 1/2892; H04R 1/2896; H04R 1/347; H04R 5/00; H04R 5/033; H04R 2201/00; H04R 2201/02; H04R 2201/028; H04R 2201/029; H04R 2201/10; H04R 2201/105
See application file for complete search history.

(56) References Cited

U.S. PATENT DOCUMENTS

2016/0165335 A1* 6/2016 Goossens ..... H04R 7/127 381/351
2018/0310090 A1* 10/2018 Wen ..... H04R 1/2811
2020/0359126 A1* 11/2020 Ong ..... H04R 1/1041

* cited by examiner

*Primary Examiner* — Walter F Briney, III
(74) *Attorney, Agent, or Firm* — JCIPRNET

(57) ABSTRACT

A head phone structure includes an earmuff casing and a speaker. The earmuff casing includes a first casing and a second casing. A first accommodating space and a first chamber are formed between the first casing and the second casing, and the first chamber is formed outside the first accommodating space. The speaker is disposed in the first accommodating space of the earmuff casing and at least includes a frame and a vibration system. A second chamber is defined and formed by the frame and the vibration system. An airflow is generated in the second chamber when the vibration system vibrates. The second chamber communicates with the first chamber of the earmuff casing.

14 Claims, 15 Drawing Sheets

HEAD PHONE STRUCTURE HAVING TWO CHAMBERS

CROSS-REFERENCE TO RELATED APPLICATION

This application claims the priority benefit of Taiwan application serial no. 108134851, filed on Sep. 26, 2019. The entirety of the above-mentioned patent application is hereby incorporated by reference herein and made a part of this specification.

BACKGROUND

Field of the Invention

The invention relates to a head phone structure and more particularly, to a head phone structure capable of satisfying a trend of miniaturization.

Description of Related Art

Generally, a rear chamber of a speaker is formed between a vibration film and a bottom wall of a frame in a head phone structure, a tuning hole of the speaker is disposed on the bottom wall of the frame, and a tuning paper may be attached to the tuning hole for tone tuning. Nevertheless, as a head phone inner casing is located closely to a bottom wall of the speaker (i.e., a position where the tuning hole is located), resonance reflection tends to occur in the presence of an insufficient distance, such that the presentation of a sound curve may be influenced. Moreover, since the head phone inner casing in most cases has an irregular shape, it may result in the occurrence of resonance due to non-smooth or unbalanced outward ventilation. Especially, current head phones are designed toward being light and thin, which makes the issue related to the insufficient distance between the tuning hole of the speaker and the head phone inner casing even worse.

SUMMARY

The invention provides a head phone structure capable of satisfying a trend of miniaturization.

A head phone structure of the invention includes an earmuff casing and a speaker. The earmuff casing includes a first casing and a second casing. A first accommodating space and a first chamber are formed between the first casing and the second casing, and the first chamber is formed outside the first accommodating space. The speaker is disposed in the first accommodating space of the earmuff casing. The speaker at least includes a frame and a vibration system, a second chamber is defined and formed by the frame and the vibration system, and an airflow is generated in the second chamber when the vibration system vibrates. The second chamber communicates with the first chamber of the earmuff casing.

In an embodiment of the invention, the earmuff casing has a tuning hole, and the airflow generated in the second chamber of the speaker after flowing through the first chamber is exhausted to an external environment through the tuning hole.

In an embodiment of the invention, the frame of the speaker has a lateral wall, a bottom wall, a second accommodation space formed between the lateral wall and the bottom wall and an opening end located at a top end of the second accommodation space. The vibration system is disposed at the second accommodation space of the frame and has a vibration film vibrating along an axis of the frame. The second chamber is defined and formed between the vibration film and the bottom wall of the frame, and the speaker includes a magnetic circuit system disposed in the second accommodation space of the frame.

In an embodiment of the invention, a through hole is formed on the lateral wall of the frame of the speaker to communicate the second chamber with the first chamber.

In an embodiment of the invention, the vibration film vibrates along the axial direction of the frame to define and form a first axial direction, the airflow generated in the second chamber flows along a second axial direction and is guided out of the through hole formed on the lateral wall of the frame, and the first axial direction and the second axial direction have an intersection angle therebetween.

In an embodiment of the invention, the first casing is partially attached to an upper surface of the opening end of the frame, and the second casing is at least partially attached to a lower surface of the bottom wall of the frame.

In an embodiment of the invention, the first chamber is formed among the first casing, the second casing and an outer periphery of the lateral wall of the frame.

In an embodiment of the invention, the head phone structure further includes a circuit board disposed on the frame and has a plurality of conductive pads, and the second casing exposes the conductive pads.

In an embodiment of the invention, a suspension side edge of the vibration film of the vibration system is attached to the opening end of the frame.

In an embodiment of the invention, a distance between a bottommost end of the first accommodation space of the earmuff casing and the suspension side edge of the vibration film is less than 6.5 mm.

In an embodiment of the invention, the bottom wall is recessed in a direction toward the vibration film, the frame includes an inner wall connected to the lower surface of the bottom wall, and a second tuning portion is formed between the lower surface of the bottom wall of the frame and the inner wall.

In an embodiment of the invention, the second tuning portion presents a C shape in a viewing angle along the axial direction and has a notch, the framework includes a platform connected to the inner wall and the lateral wall and located at the notch, and the speaker includes a circuit board disposed on the platform.

In an embodiment of the invention, the second tuning portion presents a C shape in a viewing angle along the axial direction, the bottom wall has a first through hole adjacent to an end of the C shape, the second casing is at least partially attached to the lower surface of the bottom wall of the frame, the second casing has a second through hole communicating with the second tuning portion, and the second through hole is adjacent to the other end of the C shape.

In an embodiment of the invention, a radial sectional shape of the second chamber is gradually expanded in a direction from the inside toward the lateral wall.

In an embodiment of the invention, a radial sectional shape of an upper surface of the bottom wall at least partially corresponds to a radial sectional shape of the vibration film.

Based on the above, the speaker of the head phone structure is disposed in the first accommodating space of the earmuff casing, and the first chamber is formed outside the first accommodating space. A second chamber being defined and formed by the frame and the vibration system of the speaker, the airflow is generated in the second chamber when the vibration system vibrates, and the second chamber communicates with the first chamber of the earmuff casing. Thus, when the vibration system vibrates, the airflow can flow from the second chamber to the first chamber located outside the first accommodation space, so as to achieve a tone tuning effect. As the first chamber is formed outside the first accommodating space, instead of at the rear side, even though the first casing or the second casing of the head phone structure is close to the rear side of the speaker, it neither causes resonance reflection nor influences the presentation of a sound curve.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

A head phone structure of one of the embodiments may be applied to a headset (not shown). The headset may have a racket (not shown) and two head phone structures, the racket is made of an elastic material and is worn on a user's head, the two head phone structures respectively contact the user's ears, and the air in the head phone structures is pushed through vibration generated by speakers disposed in the head phone structures, and as such, sound is generated by the speakers and transmitted to the ears. In the present embodiment, the head phone structure may satisfy a trend of miniaturization and provide a preferable sound effect. The head phone structure will be described in detail below.

Figure 1:
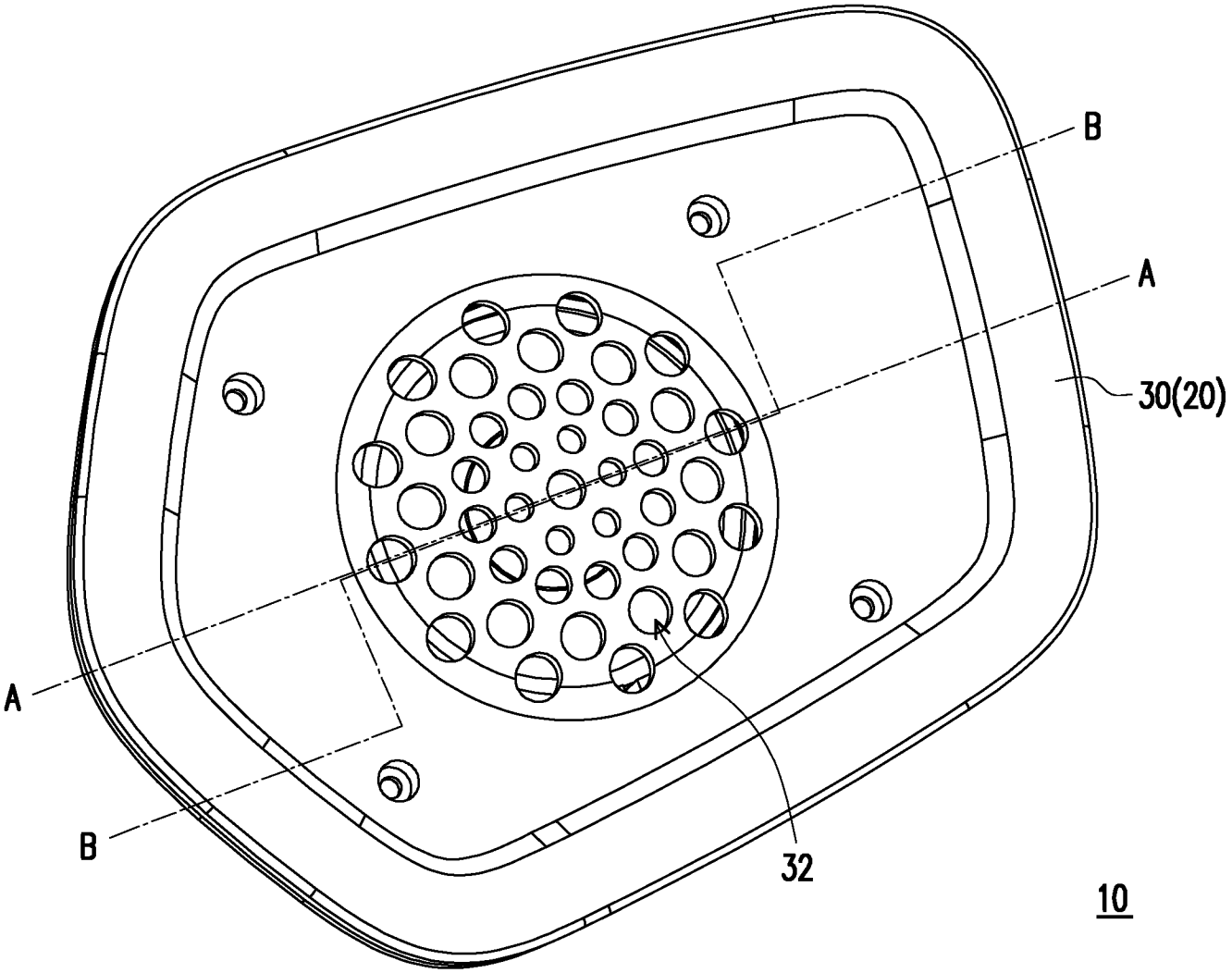
FIG. 1 is a schematic top three-dimensional (3D) diagram illustrating a head phone structure according to an embodiment of the invention.
Figure 2:
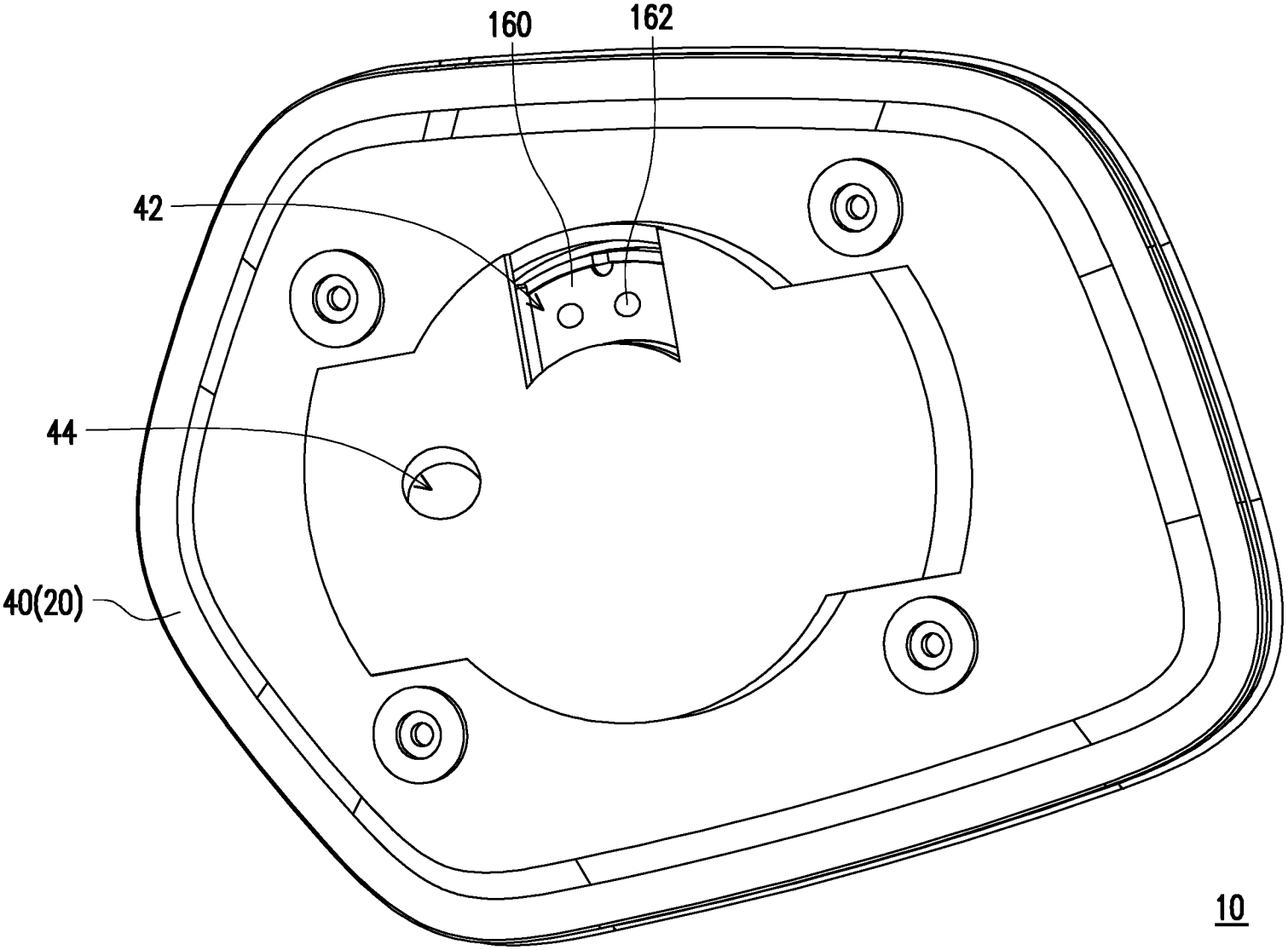
FIG. 2 is a schematic bottom 3D diagram illustrating the head phone structure depicted in FIG. 1.
Figure 3:
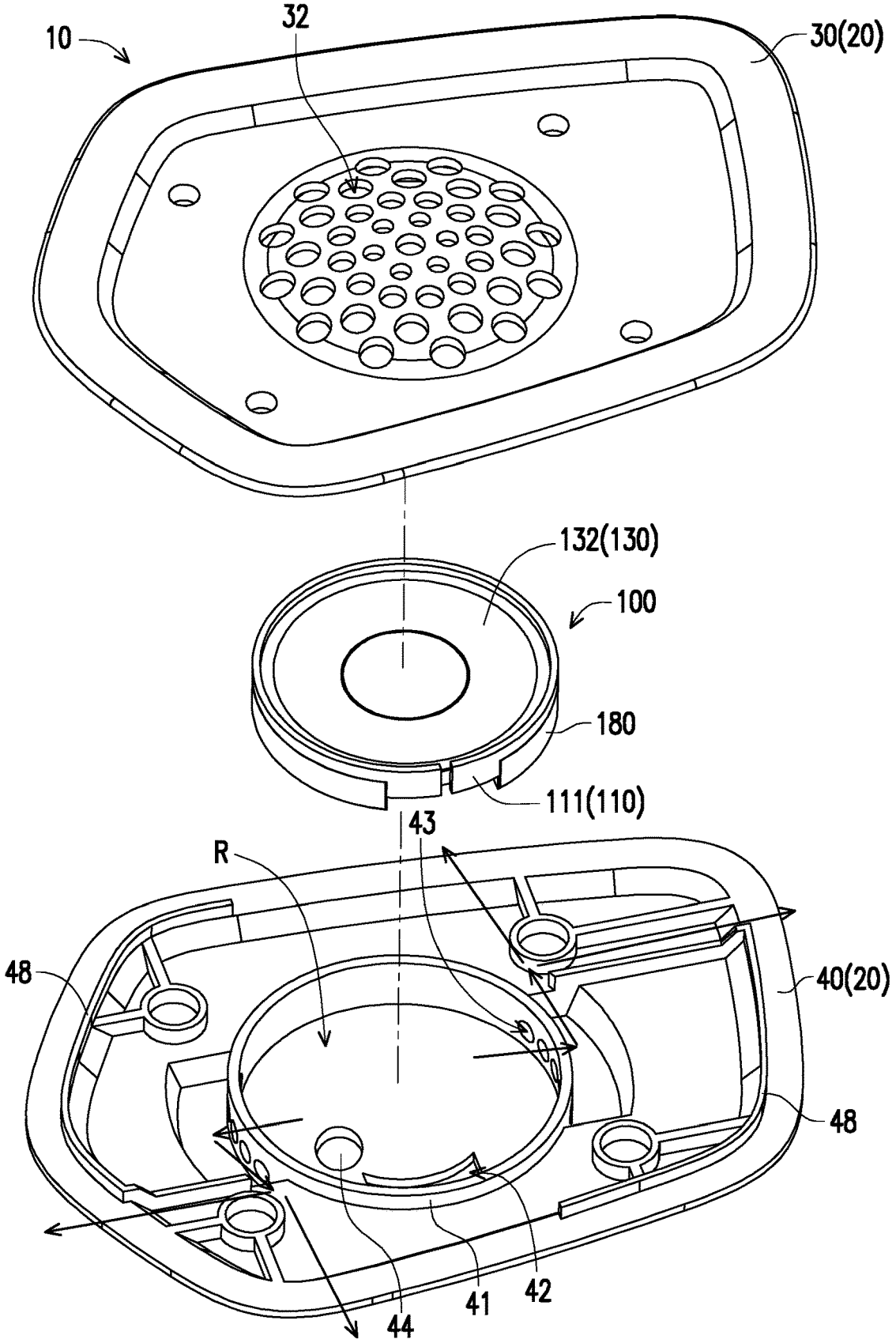
FIG. 3 is a schematic exploded diagram illustrating the head phone structure depicted in FIG. 1.
Figure 4:
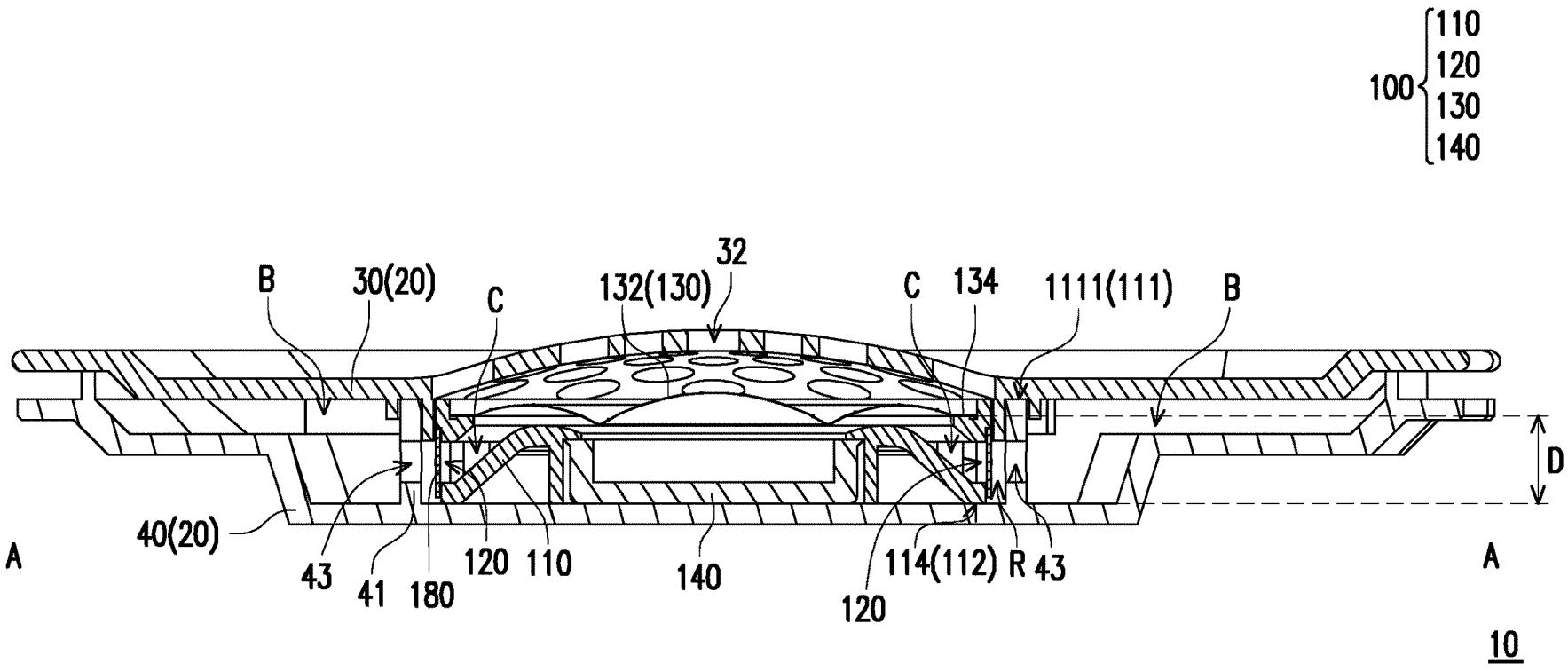
FIG. 4 is a schematic cross-sectional diagram illustrating the head phone structure depicted in FIG. 1 along a line A-A.
Figure 5:
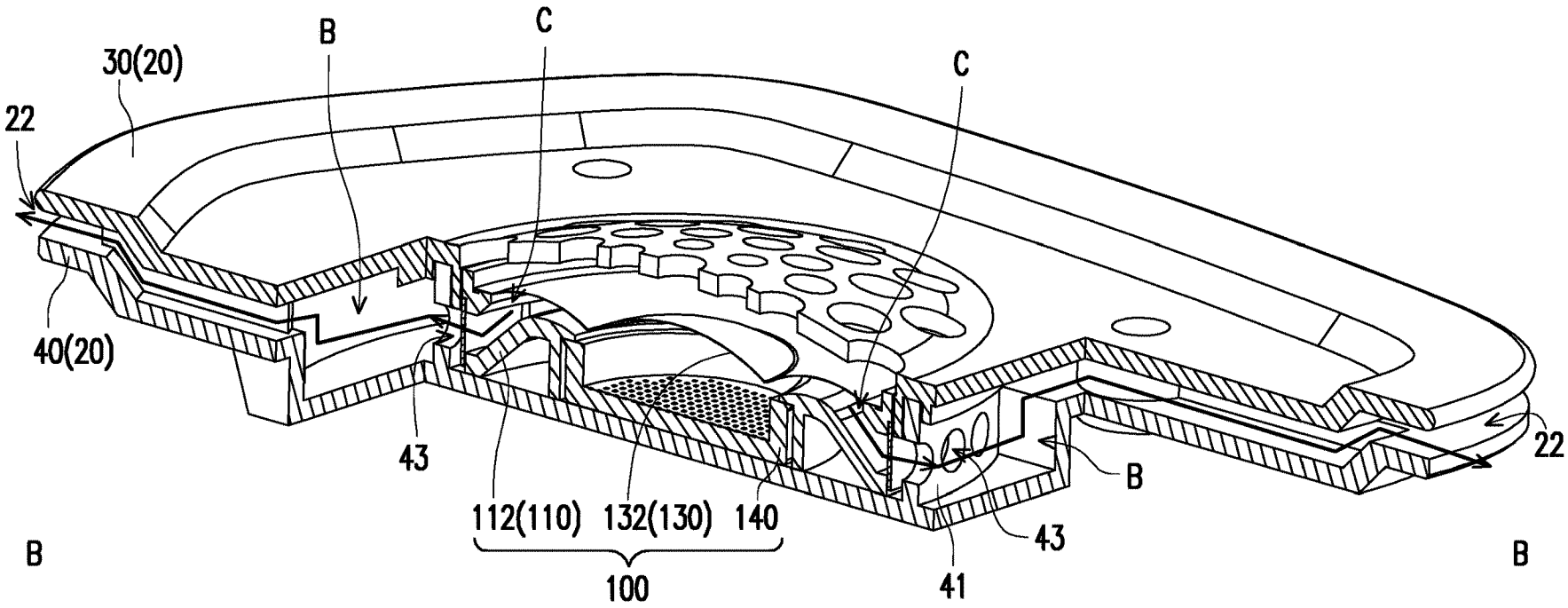
FIG. 5 is a schematic cross-sectional diagram illustrating the head phone structure depicted in FIG. 1 along a line B-B.

FIG. 1 is a schematic top three-dimensional (3D) diagram illustrating a head phone structure according to an embodiment of the invention. FIG. 2 is a schematic bottom 3D diagram illustrating the head phone structure depicted in FIG. 1. FIG. 3 is a schematic exploded diagram illustrating the head phone structure depicted in FIG. 1. FIG. 4 is a schematic cross-sectional diagram illustrating the head phone structure depicted in FIG. 1 along a line A-A. FIG. 5 is a schematic cross-sectional diagram illustrating the head phone structure depicted in FIG. 1 along a line B-B.

Referring to FIG. 1 to FIG. 5, a head phone structure 10 of the present embodiment includes an earmuff casing 20 and a speaker 100. The earmuff casing 20 includes a first casing 30 and a second casing 40. In the present embodiment, the first casing 30 is, for example, a casing which is adjacent to a user's ear. The first casing 30 has a plurality of sound transmission holes 32 communicating with a front chamber of the speaker 100. The second casing 40 is, for example, a head phone inner casing. The second casing 40 may be further covered by an appearance element (not shown), and a battery (not shown) may be disposed between the second casing 40 and the appearance element, but the types and relative positions of the first casing 30 and the second casing 40 are not limited thereto.

Referring to FIG. 4, in the present embodiment, a first accommodating space R and a first chamber B are formed between the first casing 30 and the second casing 40. The first chamber B is formed outside the first accommodating space R. The speaker 100 is disposed in the first accommodating space R of the earmuff casing 20. In the present embodiment, the speaker 100 at least includes a frame 110 and a vibration system 130. A suspension side edge 134 of the vibration film 132 of the vibration system 130 is attached to an upper surface 1111 of an opening end 118 (illustrated in FIG. 11) of the frame 110. The first casing 30 is partially attached to the upper surface 1111 of the opening end 118 of the frame 110, and the second casing 40 is at least partially attached to a lower surface 114 of a bottom wall 112 of the frame 110.

In the present embodiment, the first chamber B is formed among the first casing 30, the second casing 40 and an outer periphery of a lateral wall 111 of the frame 110. A second chamber C is defined and formed by the frame 110 and the vibration system 130, and the second chamber C communicates with the first chamber B of the earmuff casing 20.

Moreover, referring to FIG. 3, the second casing 40 has an inner ring 41, and the first accommodation space R is surrounded by the inner ring 41. The inner ring 41 has holes 43 thereon for the first chamber B (illustrated in FIG. 4) to communicate with the first accommodation space R. Moreover, in the present embodiment, the second casing 40 has padding elements 48 located in the periphery thereof, the padding elements 48 are, for example, ribs, but the type of the padding elements 48 is not limited thereto. When the first casing 20 is assembled onto the second casing 40, the padding elements 48 prop up the first casing 20, such that a tuning hole 22 (illustrated in FIG. 5) of the earmuff casing 20 is formed between the first casing 20 and the second casing 40. In the present embodiment, the tuning hole 22 communicates with the first chamber B of the earmuff casing 20.

Thus, when the vibration system 130 vibrates, an airflow is generated in the second chamber C in the speaker 100, the airflow may flow from the second chamber C to the first chamber B located outside the first accommodation space R and then be exhausted to an external environment through the tuning hole 22, so as to achieve a tone tuning effect. The air inside the second chamber C of the speaker 100 may be guided along a path for tone tuning mentioned above, thereby achieving an effect of balancing internal and external air pressures. As such, characteristics of the sound output by the head phone structure 10, such as a sound curve, an audio frequency and sound quality, may meet design requirements.

Moreover, as illustrated in FIG. 4, in the present embodiment, a distance D between a bottommost end of the first accommodation space R of the earmuff casing 20 and the suspension side edge 134 of the vibration film 132 is less than 6.5 mm. The distance D is, for example, between 5 mm and 6 mm, which is not limited in the invention. In the present embodiment, the bottommost end of the first accommodation space R is, for example, an upper surface of the second casing 40. If the second casing 40 has an non-uniform thickness, the bottommost end of the first accommodation space R may refer to a part of the upper surface of the second casing 40 which is the farthest from the vibration film 132. Since the first chamber B is formed outside the first accommodating space R, the first chamber B and the first accommodation space R is arranged in concentrical manner, such that even though the distance D between the bottommost end of the first accommodation space R and the suspension side edge 134 of the vibration film 132 is close to a rear side of the speaker 100, it neither causes resonance reflection nor influences the presentation of the sound curve. In this way, the head phone structure 10 of the present embodiment has a very thin thickness and preferable sound performance.

As illustrated in FIG. 2, in the present embodiment, the head phone structure 10 further includes a circuit board 160 disposed at the rear side of the speaker 100 and has a plurality of conductive pads 162, and the second casing 40 has a hole 42 to expose the conductive pads 162. As other circuit boards (not shown) or circuit structures (not shown) may be further disposed between the second casing 40 of the head phone structure 10 and the appearance element, the hole 42 on the second casing 40 may allow the conductive pads of the circuit board 160 in the head phone structure 10 to be exposed, such that the conductive pads 162 are electrically connected with external circuits.

Figure 6:
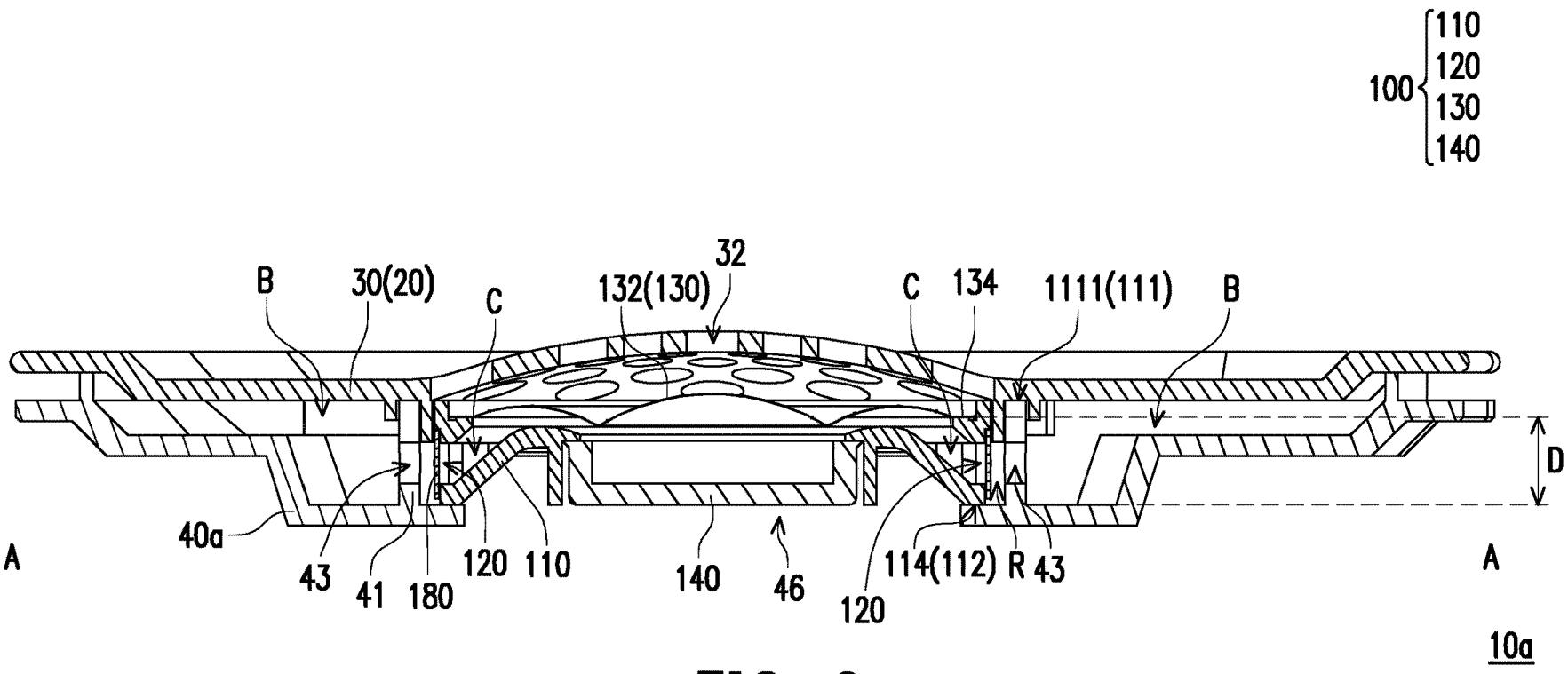
FIG. 6 is a schematic cross-sectional diagram illustrating a head phone structure according to another embodiment of the invention.

FIG. 6 is a schematic cross-sectional diagram illustrating a head phone structure according to another embodiment of the invention. Referring to FIG. 6, the main difference between a head phone structure 10*a* illustrated in FIG. 6 and the head phone structure 10 illustrated in FIG. 4B lies in that, in FIG. 6, a second casing 40*a* of the head phone structure 10*a* has an opening 46 to expose a greater part of the speaker 100 for an assembler to electrically connect the conductive pads 162 with the external circuits more conveniently and to obtain more space in the rear (i.e., a lower part illustrated in FIG. 6) of the second casing 40*a* for disposing other elements.

Figure 7:
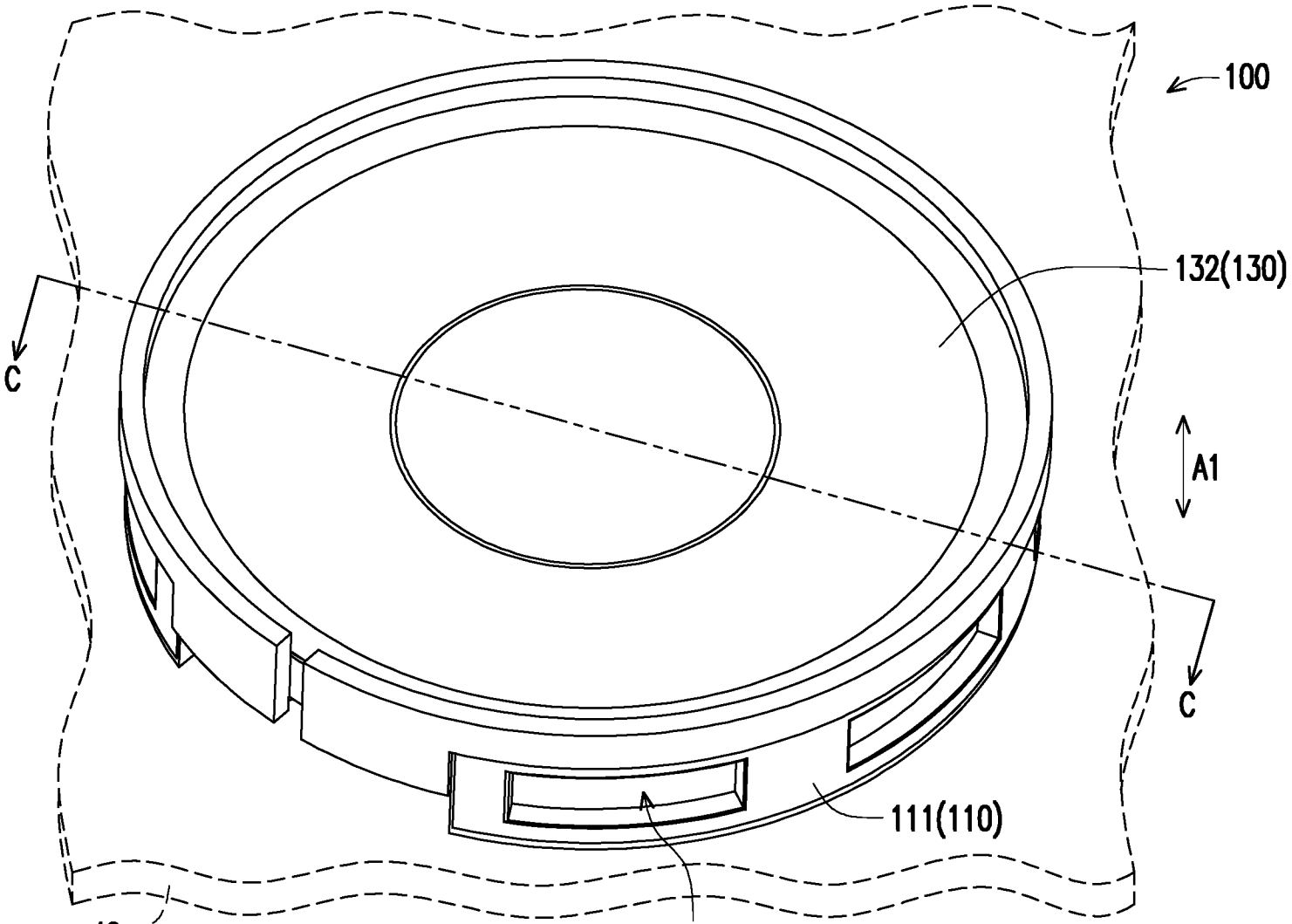
FIG. 7 is a schematic top 3D diagram illustrating a speaker according to an embodiment of the invention.
Figure 8:
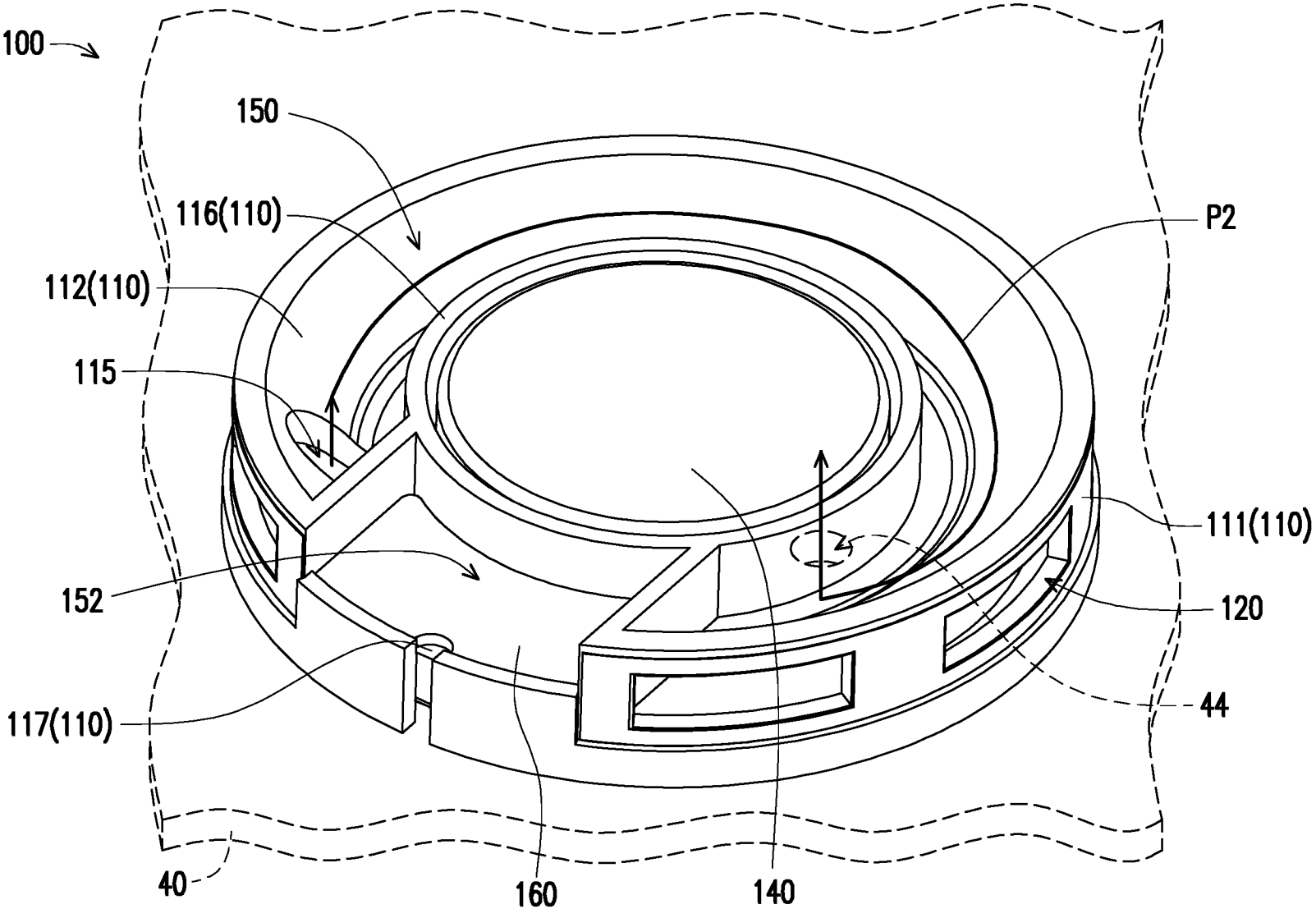
FIG. 8 is a schematic bottom 3D diagram illustrating the speaker depicted in FIG. 7.

It is to be mentioned that the speaker 100 of the head phone structure 10*a* of the present embodiment also has a special design, and the speaker 100 of the head phone structure 10 will be further described below. FIG. 7 is a schematic top 3D diagram illustrating a speaker according to an embodiment of the invention. FIG. 8 is a schematic bottom 3D diagram illustrating the speaker depicted in FIG. 7. It should be mentioned that in order to clearly illustrate a first tuning portion 120, a tuning paper 180 is hidden from FIG. 7 and FIG. 8, and to clearly show a bottom surface of the speaker 100, a plate that may be selectively disposed on the lower surface 114 of the bottom wall 112 of the frame 110 is specifically shown by dashed lines. The speaker 100 is, for example, an electrodynamic speaker, a piezoelectric speaker, an electrode speaker or other types of speakers, which is not particularly limited in the invention.

Referring to FIG. 7 to FIG. 8, the speaker 100 of the present embodiment is, for example, a speaker that is applied to a head phone, but the field that the speaker 100 is applied to is not limited thereto. The speaker 100 of the present embodiment is designed with a special structure, such that even though the second casing (e.g., a head phone inner casing) of the head phone structure is disposed closely to or directly on the bottom surface of the speaker 100, it does not cause resonance reflection and may achieve preferable sound performance, which will be described below.

Figure 9:
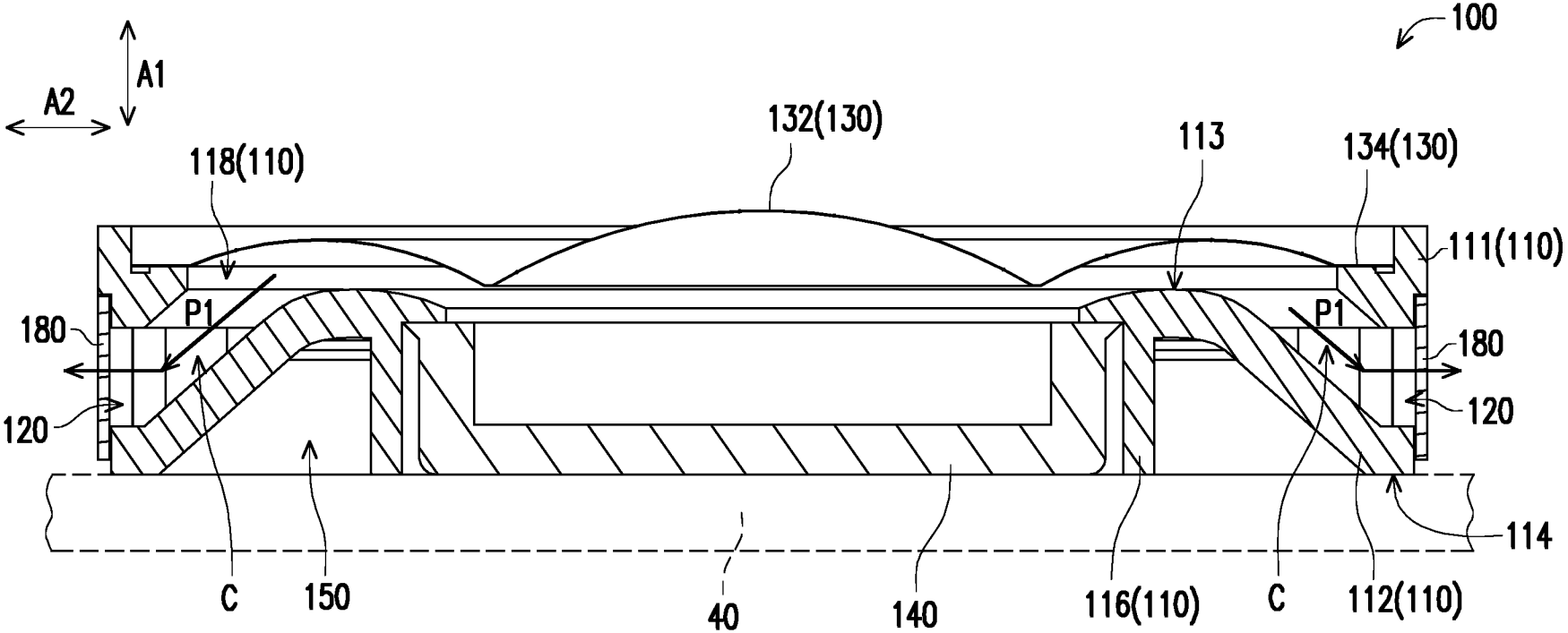
FIG. 9 is a schematic cross-sectional diagram illustrating the speaker depicted in FIG. 7 along the line A-A.
Figure 10:
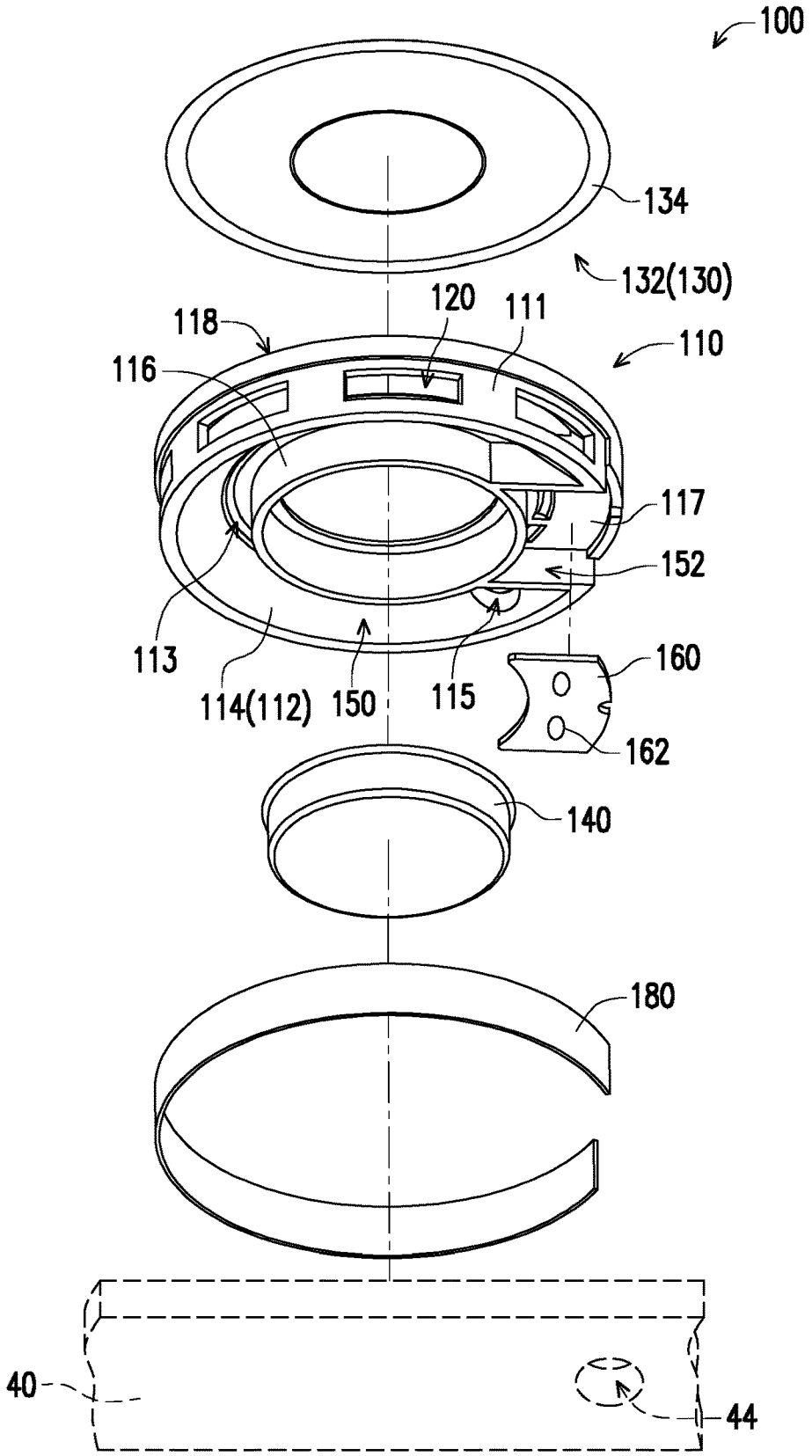
FIG. 10 is a schematic exploded diagram illustrating the speaker depicted in FIG. 7.
Figure 11:
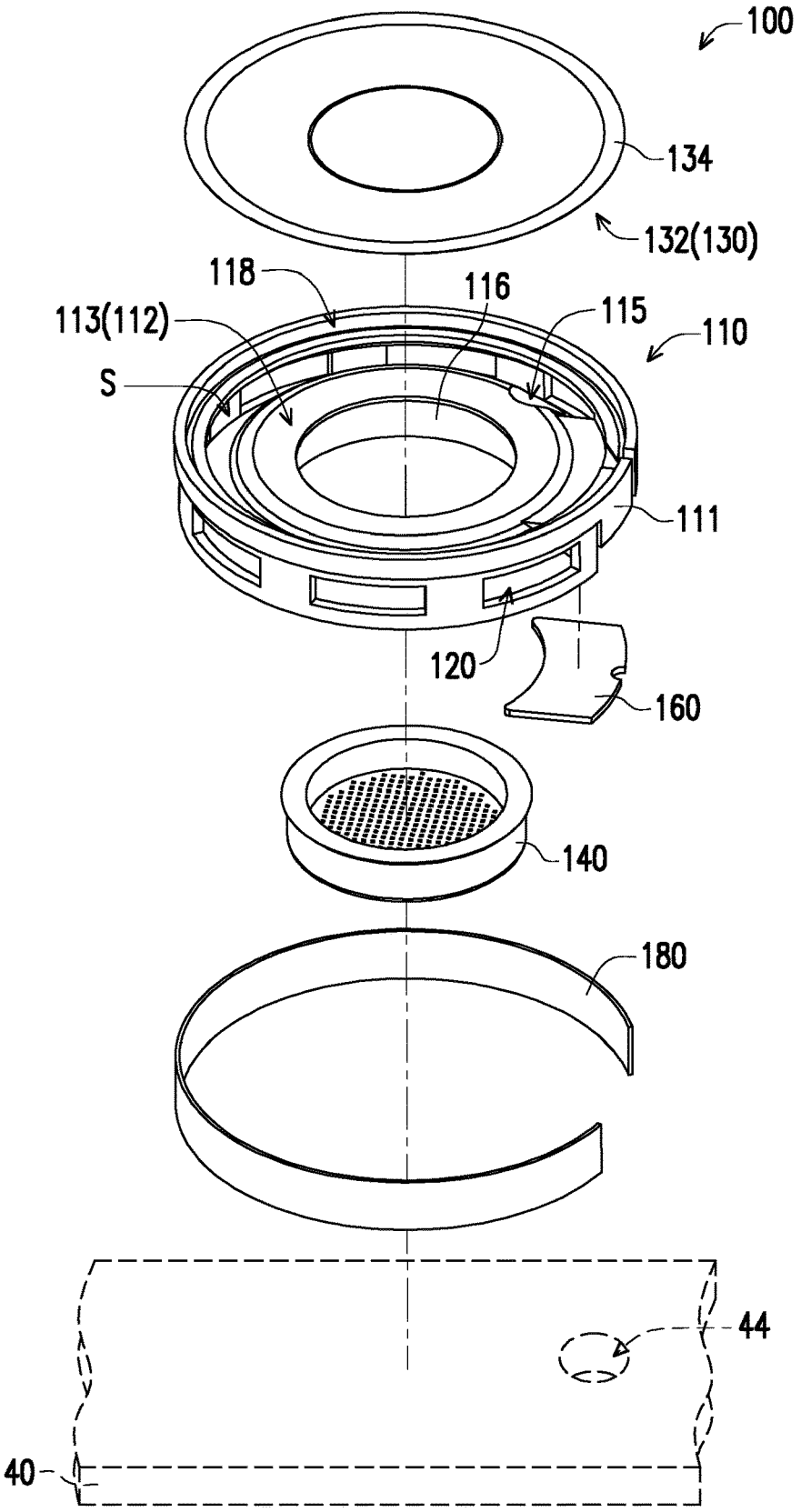
FIG. 11 is a schematic diagram of FIG. 10 in another viewing angle.

FIG. 9 is a schematic cross-sectional diagram illustrating the speaker depicted in FIG. 7 along the line A-A. FIG. 10 is a schematic exploded diagram illustrating the speaker depicted in FIG. 7. FIG. 11 is a schematic diagram of FIG. 10 in another viewing angle. Referring to FIG. 9 to FIG. 11, the speaker 100 of the present embodiment includes the frame 110, the first tuning portion 120, the vibration system 130 and a magnetic circuit system 140.

Figure 12:
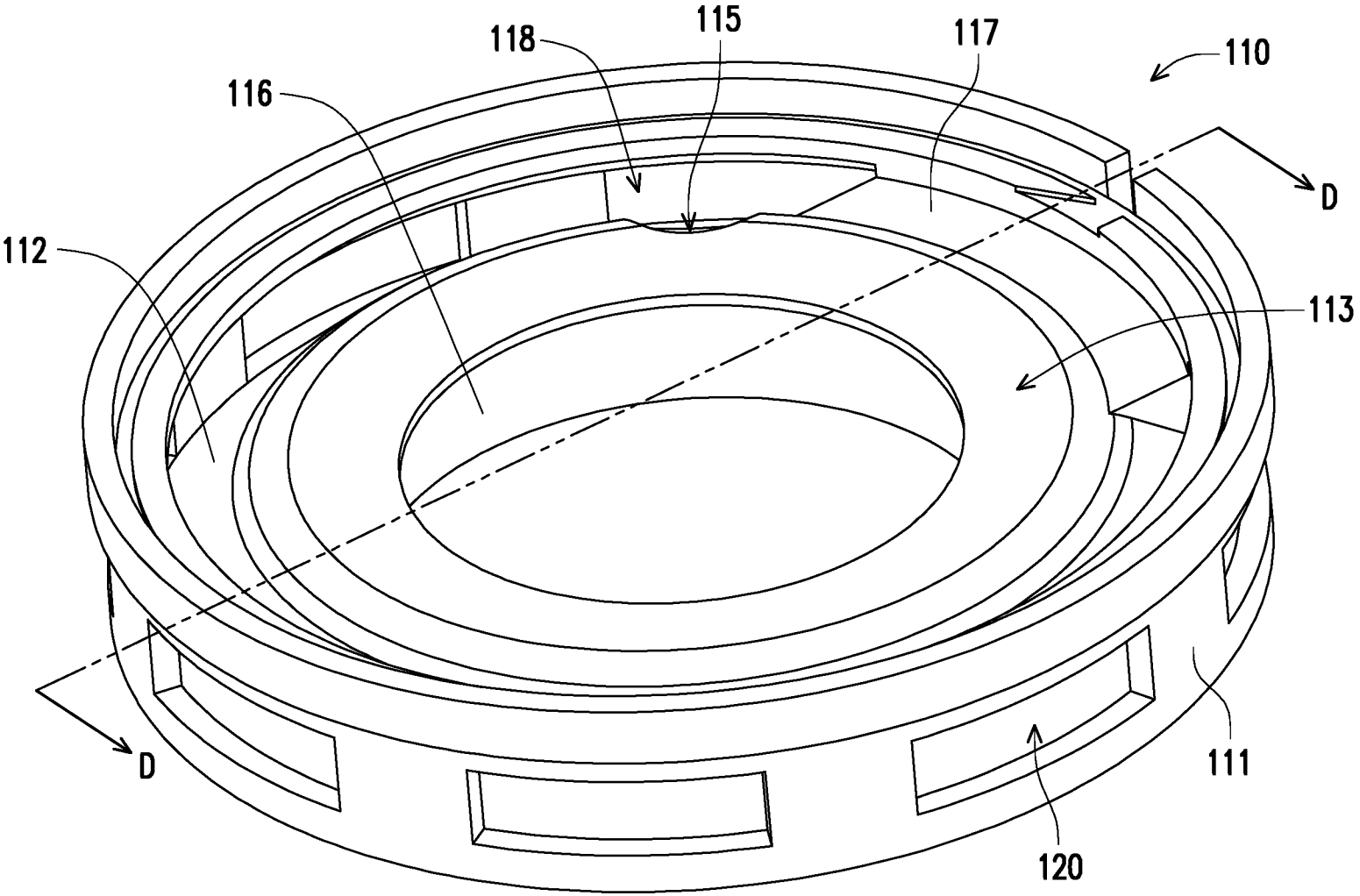
FIG. 12 is a schematic top 3D diagram illustrating the frame of the speaker depicted in FIG. 7.
Figure 13:
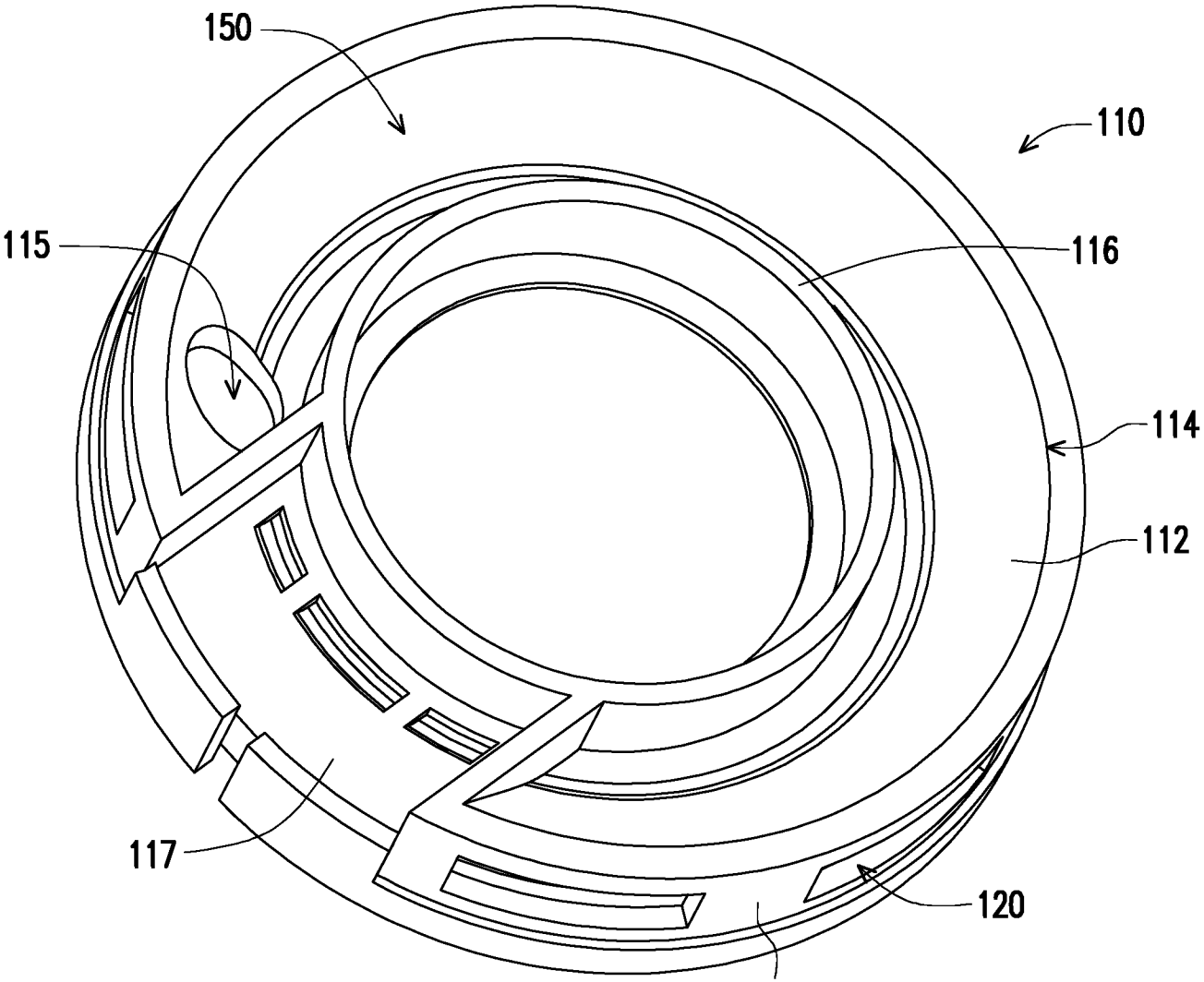
FIG. 13 is a schematic bottom 3D diagram illustrating the frame of the speaker depicted in FIG. 7.
Figure 14:
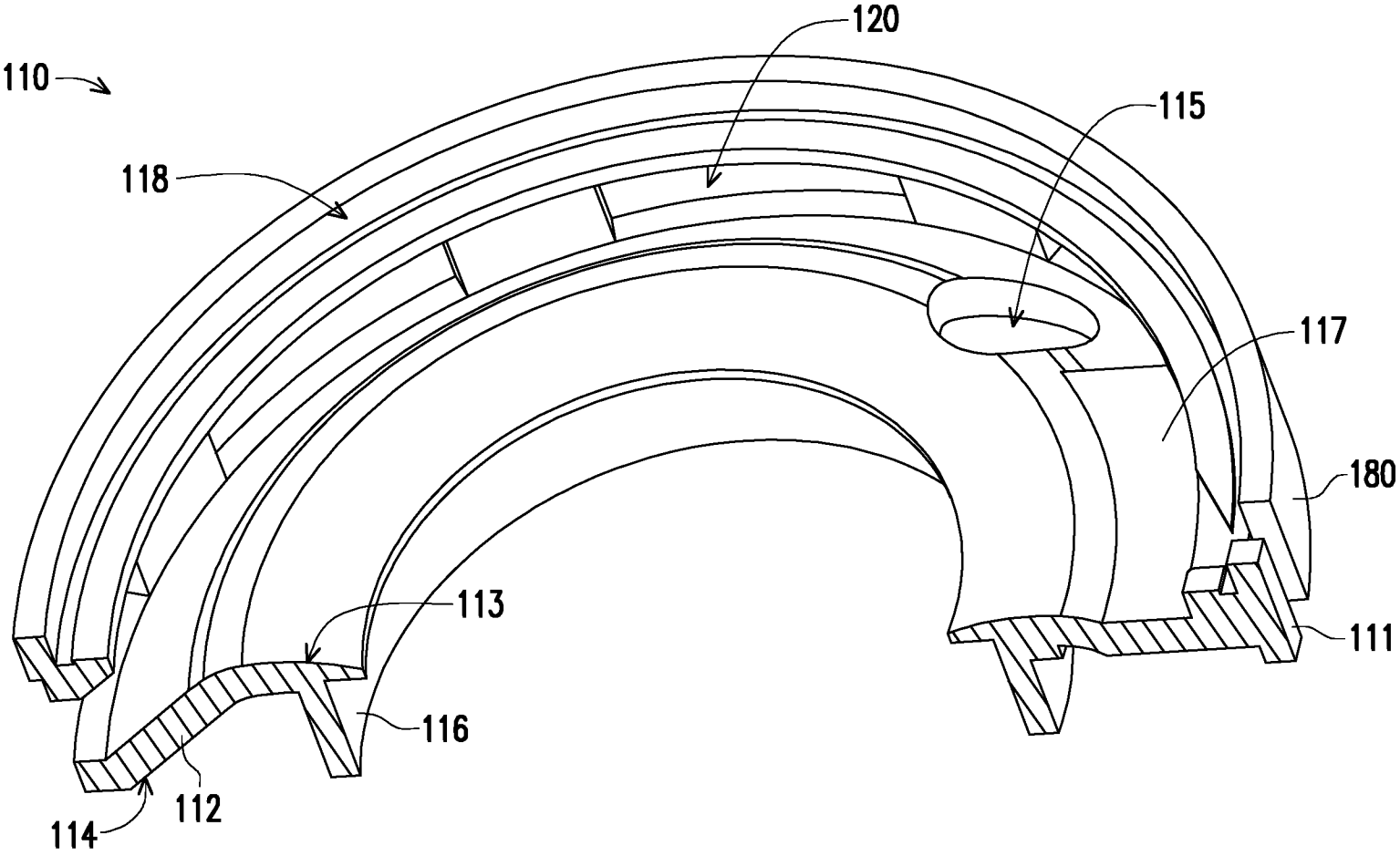
FIG. 14 is a schematic 3D diagram separated from FIG. 12 along the line B-B.
Figure 15:
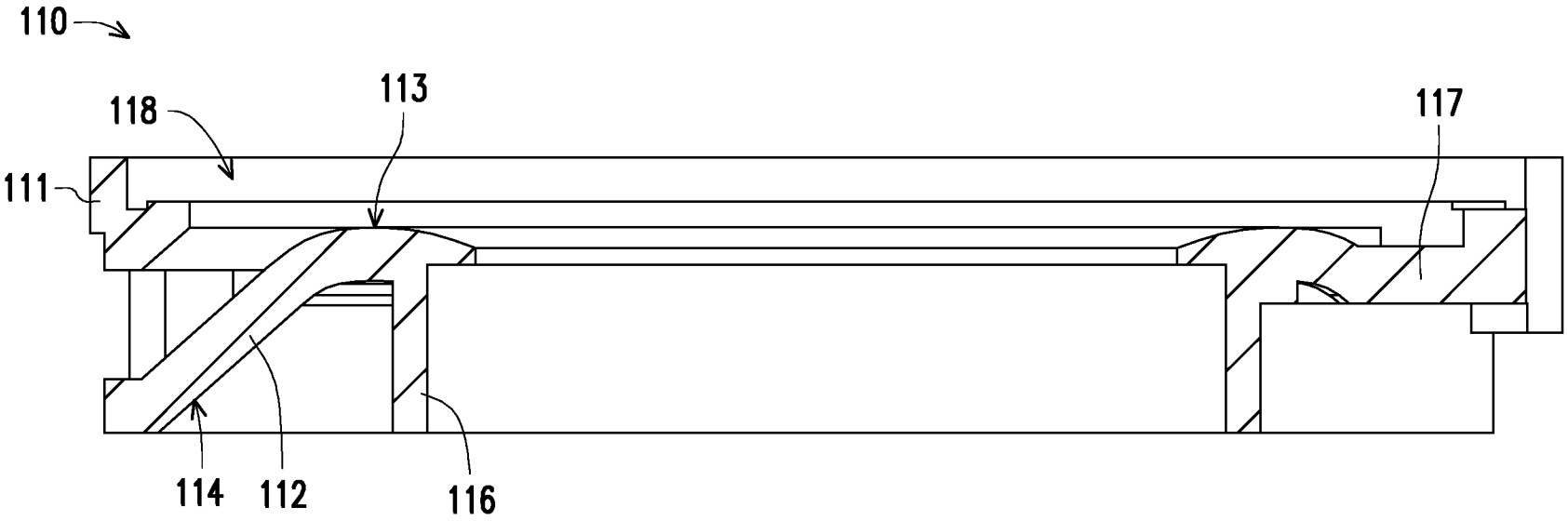
FIG. 15 is a schematic cross-sectional diagram along the line B-B of FIG. 12.

FIG. 12 is a schematic top 3D diagram illustrating the frame of the speaker depicted in FIG. 7. FIG. 13 is a schematic bottom 3D diagram illustrating the frame of the speaker depicted in FIG. 7. FIG. 14 is a schematic 3D diagram separated from FIG. 12 along the line B-B. FIG. 15 is a schematic cross-sectional diagram along the line B-B of FIG. 12.

Referring to FIG. 7 to FIG. 15, in the present embodiment, the frame 110 has the lateral wall 111, the bottom wall 112, the second accommodation space S (illustrated in FIG. 11) defined by the lateral wall 111 and the bottom wall 112 and the opening end 118 located at the top end of the accommodation space S. The first tuning portion 120 is formed on the lateral wall 111 of the frame 110. In the present embodiment, the first tuning portion 120 is formed by at least one through hole surrounding the lateral wall 111, but the form of the first tuning portion 120 is not limited thereto. The number of the first tuning portion 120 is plural, and a shape of the first tuning portion 120 may be a polygonal shape (e.g., a rectangular shape), a circular shape or other shapes. Certainly, the type, shape and number of the first tuning portion 120 are not limited thereto.

Returning to FIG. 9, the vibration system 130 is disposed at the second accommodation space S of the frame 110. The vibration system 130 includes the vibration film 132. The vibration film 132 is disposed at the opening end 118 of the frame 110. To be more specific, the suspension side edge 134 of the vibration film 132 is attached to a part of the frame 110 surrounding the opening end 118. The vibration film 132 vibrates along an axial direction of the frame 110. In this case, the axial direction of the frame 110 is presented by a first axis. The vibration film 132 moving along the axial direction (i.e., the first axis) of the frame 110 may facilitate the sound having preferable realism. The second chamber C is defined by the vibration film 132 and the bottom wall 112 of the frame 110, and the second chamber C (i.e., a rear chamber) communicates with the first tuning portion 120. It should be mentioned that the vibration system 130 actually further includes other elements, such as a voice coil (not shown), and in order to avoid too complicated lines in the figures, only the elements related to the invention are illustrated.

The magnetic circuit system 140 is disposed in the second accommodation space S of the frame 110. The magnetic circuit system 140 may include a pole piece, a permanent magnet and so on, but the invention is not limited thereto. In the present embodiment, the frame 110 further includes an inner wall 116 which is located inside the lateral wall 111 and the bottom wall 112 and communicates with the lower surface 114 of the bottom wall 112. In the present embodiment, the magnetic circuit system 140 is disposed inside the inner wall 116, but the disposition position of the magnetic circuit system 140 is not limited thereto.

It is to be mentioned that in the present embodiment, the bottom wall 112 is recessed in a direction toward the vibration film 132 (i.e., a direction toward the opening end 118). More clearly, in the present embodiment, the bottom wall 112 is connected to a side of the inner wall 116 which is adjacent to the vibration film 132 and a side of the lateral wall 111 which is far away from the vibration film 132, and in this way, the bottom wall 112 is inclined.

When the vibration film 132 vibrates along the first axis, the air in the second chamber C (i.e., the rear chamber) is extruded by the vibration film 132 which moves reciprocally to form an airflow, and the airflow flows along the inclined bottom wall 112 to the first tuning portion 120 formed on the lateral wall 111 and is guided out of the speaker 100. Thus, in the present embodiment, a first tuning path P1 (illustrated in FIG. 9) is formed jointly by the second chamber C (i.e., the rear chamber) and the first tuning portion 120. In the present embodiment, the first tuning portion 120 is used to guide the air of the second chamber C (i.e., the rear chamber), thereby achieving an effect of balancing internal and external air pressures. As such, characteristics of the sound output by the speaker 100, such as a sound curve, an audio frequency and sound quality, may meet design requirements.

In the present embodiment, the first tuning path P1 is not parallel to a vibration direction of the vibration film 132. More specifically, the airflow from the second chamber C of the first tuning path P1 flows in a direction along the inclined bottom wall 112, and the airflow from the first tuning portion 120 of the first tuning path P1 flows along a second axial direction A2 and is guided out of the first tuning portion 120 formed on the lateral wall 111 of the frame 110. The second axial direction A2 in this case refers to an axial direction of the first tuning portion 120 (a through hole) on the lateral wall 111 and is considered as a horizontal direction according to the illustration of FIG. 9. The vibration direction of the vibration film 132 which also refers to the axial direction of the frame 110 or a first axial direction A1 is considered as a vertical direction according to the illustration of FIG. 3 and is not parallel to the first tuning path P1.

It is to be mentioned that in the speaker 100 of the present embodiment, the first tuning portion 120 is formed on the lateral wall 111 of the frame 110, such that when the vibration film vibrates, the airflow generated in the second chamber C (i.e., the rear chamber) flows along the first tuning portion formed on the lateral wall 111 and is guided out of the first tuning portion 120. In other words, the airflow is exhausted from the side of the speaker 100 rather than from the bottom of the speaker. Thus, the bottom wall 112 of the speaker 100 may be disposed closely to the head phone inner casing or other elements, while a distance between the bottom wall 112 of the speaker 100 and the elements located in the rear neither causes the resonance reflection nor influences the sound curve of the speaker 100, so as to achieve preferable sound performance. As such, the speaker 100 may be applied to an electronic device, such as a thin head phone.

Moreover, it may clearly show according to the illustration of FIG. 9 that in the present embodiment, a radial sectional shape of the second chamber C (i.e., the rear chamber) is gradually expanded in a direction from the inside toward the lateral wall 111 (i.e., two sides in FIG. 9). Alternatively, the radial sectional shape of the second chamber C (i.e., the rear chamber) is gradually expanded in a radiation direction. More specifically, in the present embodiment, a part of the bottom wall 112 which is adjacent to the inner wall 116 has a closer distance to the vibration film 132, and other parts of the bottom wall 112 which are farther away from the inner wall 116 have gradually increased distances to the vibration film 132. Such design may allow the airflow to flow along the first tuning path P1 more smoothly to be exhausted, thereby reducing acoustic resistance.

Moreover, in the present embodiment, a radial sectional shape of an upper surface 113 of the bottom wall 112 at least partially corresponds to the radial sectional shape of the vibration film 132. It specially refers to the part of the bottom wall 112 which is adjacent to the inner wall 116, and the radial sectional shape of the upper surface 113 of the part corresponds to the radial sectional shape of the vibration film 132. Such design may achieve preferable performance of the sound at a high-frequency band.

In the present embodiment, the vibration film 132 vibrates along the axial direction of the frame 110 to define the first axial direction A1 and to define the axial direction of the first tuning portion 120 (the through hole) on the lateral wall 111 as the second axial direction A2. The first axial direction A1 and the second axial direction A2 have an intersection angle therebetween. For example, the first axial direction A1 and the second axial direction A2 have a vertical angle (90 degrees) therebetween. Certainly, the angle between the first axial direction A1 and the second axial direction A2 is not limited thereto.

Returning to FIG. 2, in the present embodiment, since the bottom wall 112 is recessed toward the vibration film 132, a second tuning portion 150 is formed between the lower surface 114 of the bottom wall 112 of the frame 110 and the inner wall 116. The bottom wall 112 has a first through hole 115 to allow the second chamber C (i.e., the rear chamber) and the second tuning portion 150 to communicate with each other.

Moreover, it may be clear shown in a viewing angle along the axial direction that the second tuning portion 150 presents a C shape, the first through hole 115 of the bottom wall 112 is adjacent to an end of the C shape, the second casing 40 has a second through hole 44 communicating with the second tuning portion 150, the second through hole 44 is adjacent to the other end of the C shape, and a second tuning path P2 is formed by the first through hole 115, the second tuning portion 150 and the second through hole 44. Certainly, relative positions of the first through hole 115 of the bottom wall 112 and the second through hole 44 of the second casing 40 are not limited thereto.

In the present embodiment, the first tuning path P1 constituted by the second chamber C (i.e., the rear chamber) and the first tuning portion 120 formed on the lateral wall 111 is capable of tuning sound in all bands (e.g., bands between frequencies 20 Hz and 20 KHz, which is not limited in this case). Moreover, the second tuning path P2 constituted by the first through hole 115, the second tuning portion 150 and the second through hole 44 is capable of tuning sound in low-frequency bands (e.g., bands between frequencies 20 Hz and 200 Hz, which is not limited in this case). Thus, the speaker 100 of the present embodiment may achieve a dual tuning effect with the aforementioned structure.

According to the illustration of FIG. 8, in the present embodiment, the second tuning portion 150 presenting the C shape has a notch 152, the frame 110 further includes a platform 117 connected to the inner wall 116 and the lateral wall 111 and located at the notch 152. The circuit board 160 is disposed on the platform 117. Certainly, a shape of the second tuning portion 150 and a position where the circuit board 160 is disposed on the frame 110 are not limited thereto.

Moreover, according to the illustration of FIG. 9, the speaker 100 further include a tuning paper 180 disposed at the lateral wall 111 to shield the first tuning portion 120. A designer may select the tuning paper 180 with acoustic resistance at different levels according to desired tuning effects, and the type, shape, number of the 180 and a corresponding relationship with the first tuning portion 120 are not limited herein.

Based on the above, the speaker of the head phone structure is disposed in the first accommodating space of the earmuff casing, and the first chamber is formed outside the first accommodating space. The second chamber is defined and formed by the frame and the vibration system of the speaker. When the vibration system vibrates, the airflow is generated in the second chamber, and the second chamber communicates with the first chamber of the earmuff casing. Thus, when the vibration system vibrates, the airflow can flow from the second chamber to the first chamber located outside the first accommodation space, so as to achieve the tone tuning effect. As the first chamber is formed outside the first accommodating space, instead of at the rear side, such that even though the first casing or the second casing of the head phone structure is close to the rear side of the speaker, it neither causes resonance reflection nor influencing the presentation of the sound curve.

What is claimed is:

1. A head phone structure, comprising:

an earmuff casing, comprising a first casing and a second casing, a first accommodating space and a first chamber being formed between the first casing and the second casing, and the first chamber being formed outside the first accommodating space; and a speaker, disposed in the first accommodating space of the earmuff casing and at least comprising a frame and a vibration system, a second chamber being defined and formed by the frame and the vibration system, and an airflow being generated in the second chamber when the vibration system vibrates, wherein the second chamber communicates with the first chamber of the earmuff casing, wherein the frame of the speaker has a bottom wall and the vibration system comprises a vibration film vibrating along an axial direction of the frame, wherein a second tuning portion is formed between a lower surface of the bottom wall of the frame and an inner wall, wherein the second tuning portion presents a C shape in a viewing angle along the axial direction, the bottom wall has a first through hole adjacent to an end of the C shape, the second casing is at least partially attached to the lower surface of the bottom wall of the frame, the second casing has a second through hole communicating with the second tuning portion, and the second through hole is adjacent to the other end of the C shape.

2. The head phone structure according to claim 1, wherein the earmuff casing has a tuning hole, wherein the airflow generated in the second chamber of the speaker after flowing through the first chamber is exhausted to an external environment through the tuning hole.

3. The head phone structure according to claim 1, wherein the frame of the speaker has a lateral wall, the bottom wall, a second accommodation space formed between the lateral wall and the bottom wall and an opening end located at a top end of the second accommodation space, the vibration system is disposed at the second accommodation space of the frame, the second chamber is defined and formed between the vibration film and the bottom wall of the frame, and the speaker comprises a magnetic circuit system disposed in the second accommodation space of the frame.

4. The head phone structure according to claim 3, wherein a through hole is formed on the lateral wall of the frame of the speaker to communicate the second chamber with the first chamber.

5. The head phone structure according to claim 4, wherein the vibration film vibrates along the axial direction of the frame to define and form a first axial direction, the airflow generated in the second chamber flows along a second axial direction and is guided out of the through hole formed on the lateral wall of the frame, and the first axial direction and the second axial direction have an intersection angle therebetween.

6. The head phone structure according to claim 3, wherein the first casing is partially attached to an upper surface of the opening end of the frame, and the second casing is at least partially attached to the lower surface of the bottom wall of the frame.

7. The head phone structure according to claim 3, wherein the first chamber is formed among the first casing, the second casing and an outer periphery of the lateral wall of the frame.

8. The head phone structure according to claim 3, further comprising:

a circuit board, disposed on the frame and having a plurality of conductive pads, and the second casing exposes the conductive pads.

9. The head phone structure according to claim 3, wherein a suspension side edge of the vibration film of the vibration system is attached to the opening end of the frame.

10. The head phone structure according to claim 9, wherein a distance between a bottommost end of the first accommodation space of the earmuff casing and the suspension side edge of the vibration film is between 5 mm and 6 mm.

11. The head phone structure according to claim 3, wherein the bottom wall is recessed in a direction toward the vibration film, the frame comprises the inner wall connected to the lower surface of the bottom wall.

12. The head phone structure according to claim 11, wherein the second tuning portion has a notch, the framework comprises a platform connected to the inner wall and the lateral wall and located at the notch, and the speaker comprises a circuit board disposed on the platform.

13. The head phone structure according to claim 3, wherein a radial sectional shape of the second chamber is gradually expanded in a direction from the inside toward the lateral wall.

14. The head phone structure according to claim 3, wherein a radial sectional shape of an upper surface of the bottom wall at least partially corresponds to a radial sectional shape of the vibration film.

* * * * *